US006453579B1

(12) United States Patent
Luprete

(10) Patent No.: US 6,453,579 B1
(45) Date of Patent: Sep. 24, 2002

(54) SUPPORT SHOE

(76) Inventor: Camellia Ann Luprete, 218 Waco Ave., League City, TX (US) 77573

( * ) Notice: Subject to any disclaimer, the term of this patent is extended or adjusted under 35 U.S.C. 154(b) by 0 days.

(21) Appl. No.: 09/844,562

(22) Filed: Apr. 28, 2001

Related U.S. Application Data

(63) Continuation-in-part of application No. 09/315,472, filed on May 20, 1999, now abandoned.

(51) Int. Cl.[7] ..... A43B 7/14; A43B 11/00; A43C 11/00

(52) U.S. Cl. ..... 36/88; 36/51; 36/50.1; 36/89

(58) Field of Search ..... 36/54, 88, 55, 36/51, 50.1, 58.5, 93, 91, 102, 104, 89, 71

(56) References Cited

U.S. PATENT DOCUMENTS 351,817 A * 11/1886 Treat ..... 36/51
608,253 A * 8/1898 Cook ..... 36/51
793,095 A * 6/1905 Rapp ..... 36/54
1,743,689 A * 1/1930 Scoggins ..... 36/89
1,986,580 A * 1/1935 Johnson ..... 36/89
2,591,211 A * 4/1952 Spencer ..... 36/54
4,726,126 A * 2/1988 Bernhard ..... 36/89
4,926,569 A * 5/1990 Bunch ..... 36/91
5,337,493 A * 8/1994 Hill ..... 36/54
5,416,987 A * 5/1995 Bemis et al. ..... 36/50.1
5,692,319 A * 12/1997 Parker et al. ..... 36/89
5,765,296 A * 6/1998 Ludemann et al. ..... 36/51
5,779,246 A * 7/1998 Bengtsson ..... 36/89

* cited by examiner

*Primary Examiner*—Anthony D. Stashick
(74) *Attorney, Agent, or Firm*—Karen B. Tripp; Elizabeth Layman

(57) ABSTRACT

An athletic or therapeutic support shoe is disclosed that provides ankle support and support for the foot muscles underlying and surrounding the arch. The shoe is a dual lace-up type, with two layers, offset eyelets, and an "extra" eyelet at the ankle that allows adjustment to fit the wearer's foot and provides support. The interior layer effectively surrounds or encases the foot, or at least the arch and ankle, like a glove. An elastic "lining" and elastic inserts in the shoe provide additional flexibility and support. Strategically placed slits provide flexibility without loss of support.

3 Claims, 7 Drawing Sheets

SUPPORT SHOE

This invention is a continuation-in-part of U.S. patent application Ser. No. 09/315,472 and claims priority filing date of May 20, 1999 now abandoned.

BACKGROUND OF THE INVENTION

This invention relates to the field of athletic shoes, and particularly to shoes providing support for the foot muscles and ankle.

There are many varieties of athletic shoes on the market today, but surprisingly none that provide support for the foot muscles underlying and surrounding the arch and which also provide support for the ankle, while still allowing for some flexibility of the foot and ankle. Such support is needed for sports providing high stress to the foot and foot muscles, such as power lifting. A shoe highly suited for such activities is more fully described below.

SUMMARY OF THE INVENTION

A shoe is disclosed that has dual lacing to enable a better, more secure fit, and better ankle and foot support than single lacing provides. The shoe has closer spacing of eyelets for the lacing, at least over the ankle area, than is traditional or common with lace-up shoes. These eyelets or grommets to facilitate the lacing are in dual sides or side layers of the shoe which extend from the body of the shoe at least to the ankle of the wearer. Preferably, these layers fully cover or extend past the ankle. The interior layer also extends under at least the arch of the foot. In one embodiment an elastic-material type insert is located near the arch. The exterior layer may also extend under the foot or may connect to the main body of the shoe along the sides or top surface of the sole or inner sole. At least one of the layers has an insert of a strong, flexible material attached over at least one slit positioned over the ankle area. The shoe has a tongue attached to the main body of the shoe,

DETAILED DESCRIPTION OF THE PREFERRED EMBODIMENTS

Figure 1:
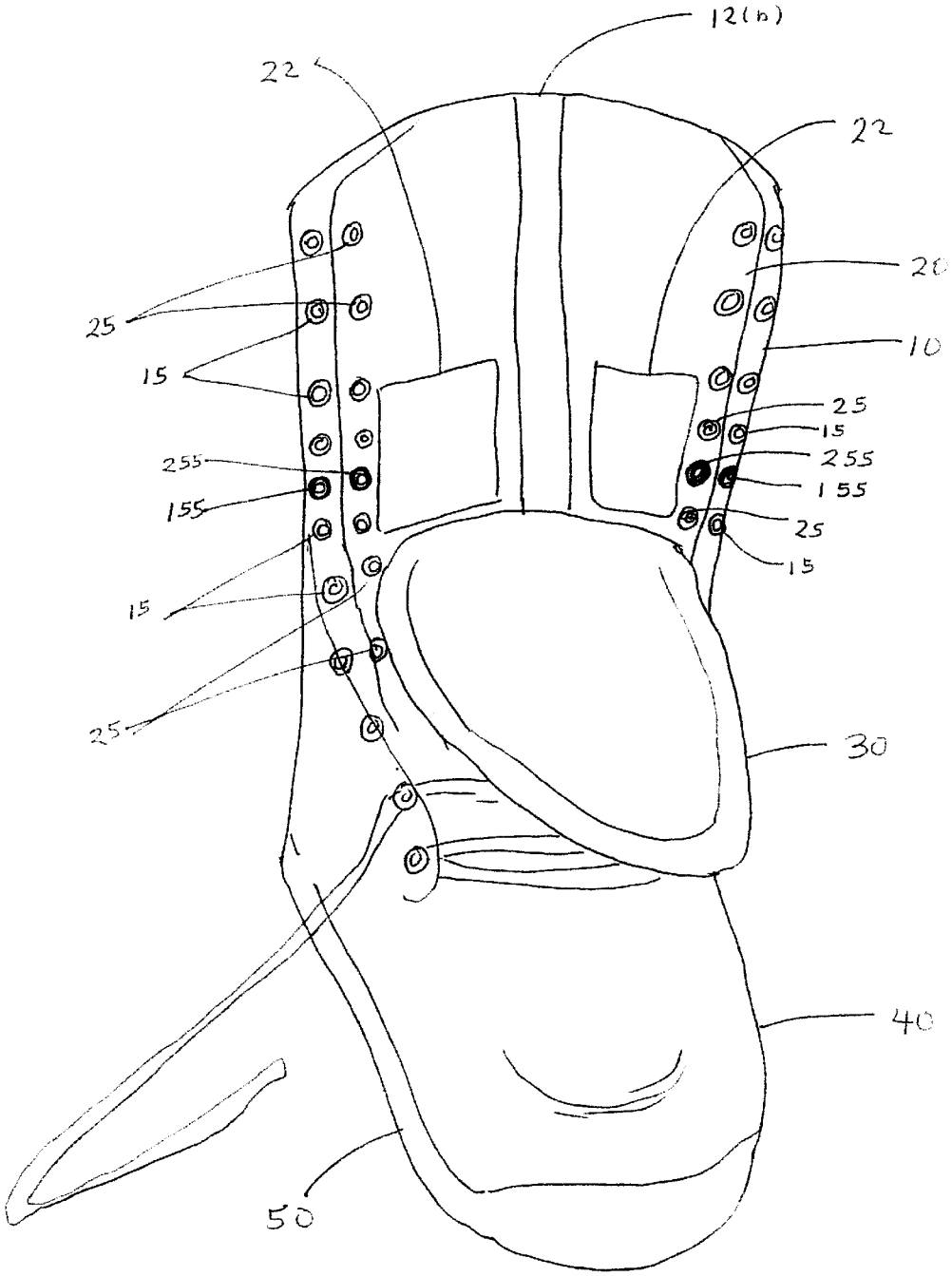
FIG. 1 shows a frontal view of a shoe of this invention with the tongue folded down to allow view of the interior of the shoe.
Figure 6:
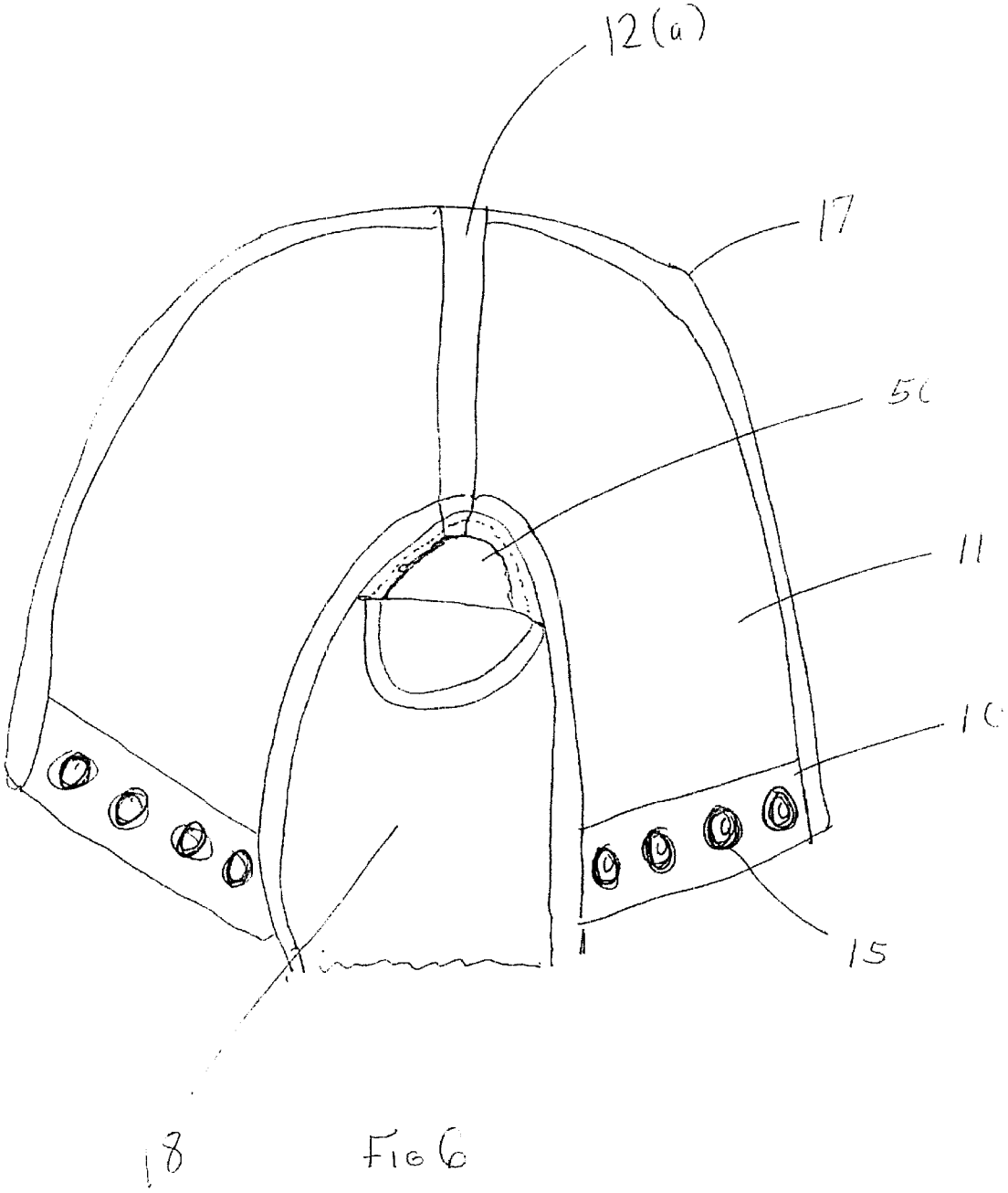
FIG. 6 is a top view of the interior of the rear portion of a shoe of this invention with the front portion cut away and the inner sole partially folded back to show the underlying interior side of the sole of the shoe.

Referring to FIG. 1, the shoe of this invention is comprised of an outer layer 10 and an inner layer 20. The inner layer 20 is a continuous piece or is connected together (by means known in the art such as by stitching) along its bottom portion that will be over an inner sole 18 or a sole 50 and along a rear portion 12 as shown in FIGS. 1, 2, 5, and 6. An outer layer 10 is also a continuous piece or connected together by stitching or sticking along its bottom portion that will lie over the inner sole 18 or the sole 50, or indirectly connected by stitching or sticking at least along the outer edge of the inner sole 18 or at least along the outer edge of the top side of the sole 50 of the shoe as shown in FIG. 6 or along the entire top side of the inner sole 18 or top or interior side of the sole 50 (if the shoe has no inner sole 18).

A rear portion 12 of the shoe can be a separate piece of material, but may alternatively be a continuous part of either or both of the inner layer 20 and/or the outer layer 10. The rear portion 12 can be comprised of an elastic-type material when used to connect side pieces of the inner layer 20. In such case, the outer layer 10 may have a rear portion 12(*a*) separate from the rear portion 12(*b*) connecting the side pieces of the layer 20. These rear portions 12(*a*) and 12(*b*) need not be connected to each other. The rear portion 12, if a piece of material separate from layers 10 and 20, may alternatively be comprised of a strip of leather, canvas, rubber, synthetic or other material. Such strip should preferably be at least as rigid as layers 10 and 20.

The outer and inner layers 10 and 20, and rear portion 12, if a continuous part of the layer 10 or the layer 20, may be comprised of leather, a synthetic fabric, canvas, or other material typically used for shoes. The inner layer 20 may be comprised of the same material as the layer 10 or of a different material. Since the layer is the layer that is next to the foot and ankle, the material comprising the layer is preferably soft but still sufficiently rigid to provide some support. Canvas, thin glove-type leather or synthetic material, or a thin foam padded material or foam backed synthetic material are examples of suitable materials for the layer 20. Any padding used in the layer preferably does not exceed about a quarter inch in thickness to avoid unnecessary bulkiness of the shoe. In selecting materials for layers 10 and 20, generally leather will provide more support than a canvas type material, but a canvas type material will typically be lighter in weight than leather. The inner sole 18 may be comprised of any material typically used for shoe inner soles, such as thin leather, canvas, plastic or other synthetic leather type material.

The desired height of layers 10 and will depend on the personal preferences of the shoe wearer and the shoe manufacturer and on the sport or use for which the shoe will be worn. For sports for which ankle support, as well as support for the foot muscles, is desired, such as for power lifting, layers 10 and should preferably extend well above the ankle, like for example the shoe shown in FIGS. 1 and 3, but preferably not so high as to interfere with flexing of the gastrocnemius muscle or the knee. Advantages of this invention may also be obtained with a shoe with sides that just extend to or past of the ankle as is common for basketball or running shoes or shoes called "three-quarter" shoes (not shown).

Layers 10 and have openings 15 and 25 respectively, formed by eyelets, along their front edge near tongue 30. Such openings 15 and 25 allow for lacing of the shoe. Each of the openings 15 should correspond in an offset manner to each of the openings 25 to facilitate lacing of the shoe with some conformation to the ankle. It is important to this invention that at least one of the openings 15 and at least one of the openings 25 on each side of the layer 10 and the layer 20 respectively be positioned at or near the place that the layers 10 and will lay over the ankle. Such openings 155 and 255 may be spaced closer to the other openings 15 and 25 respectively above and below them than the remainder of the openings 15 and 25 are spaced with respect to each other. The exact number of openings will depend on the height of layers 10 and 20, although seven to ten may be a typical number for a shoe designed for power lifting and five to eight may be typical for a "three-quarter" shoe or a shoe designed for running or basketball.

Preferably, the lacing of the shoe is through one layer and then another for each opening 15 and 25, in a criss-cross manner as would be typical in lacing layers together, to maximize adjustment of the shoe to fit the wearer's foot and to maximize support provided by the shoe for the foot. Shoestrings comprised of cotton have been found to slip less than shoestrings comprised of a synthetic material and are thus preferred, particularly when the shoe will be under a lot of stress, as when the wearer may be doing power lifting.

Figure 4:
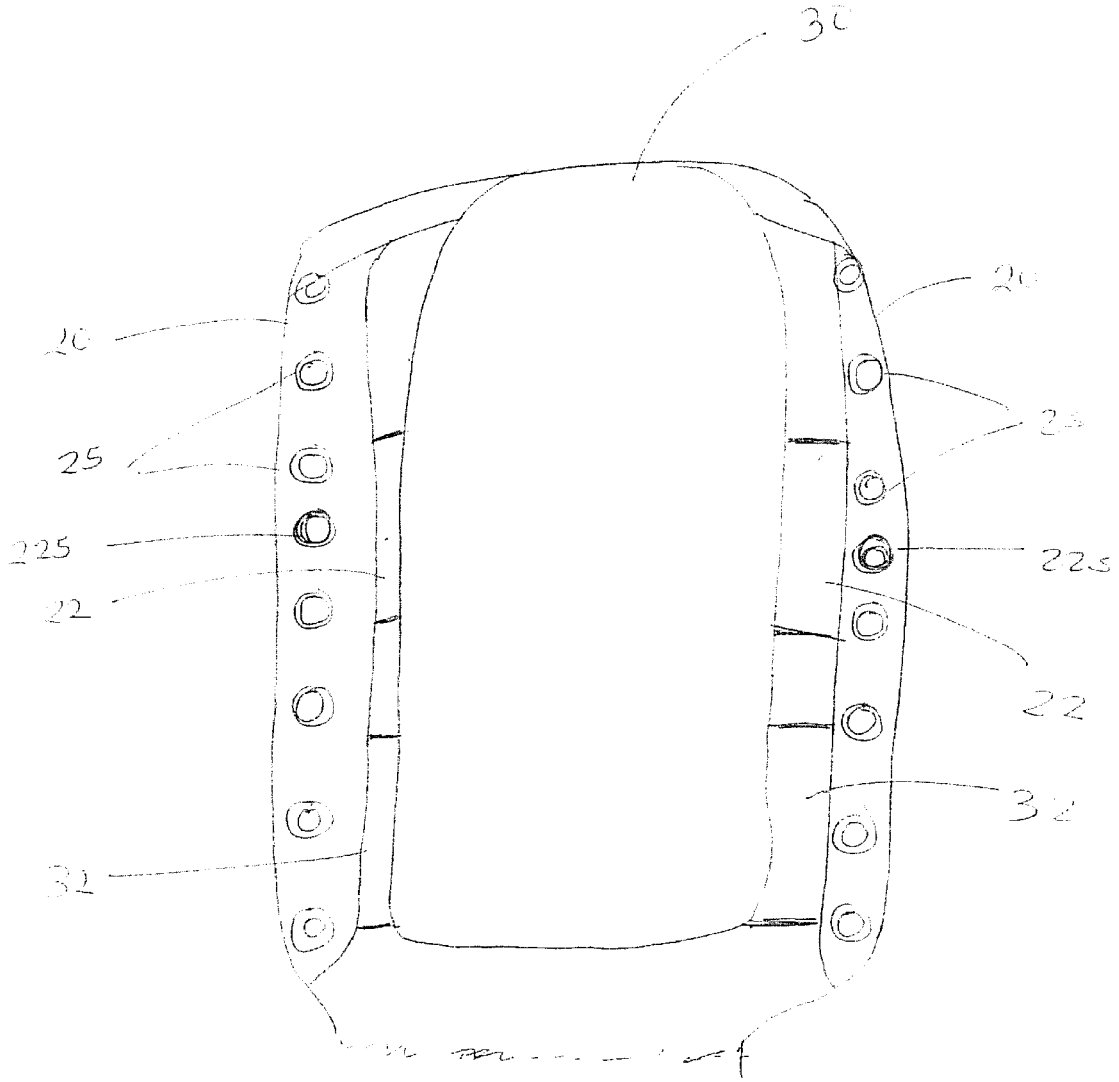
FIG. 4 shows a cut-away view of the top of a shoe of this invention, showing the tongue of the shoe.
Figure 5:
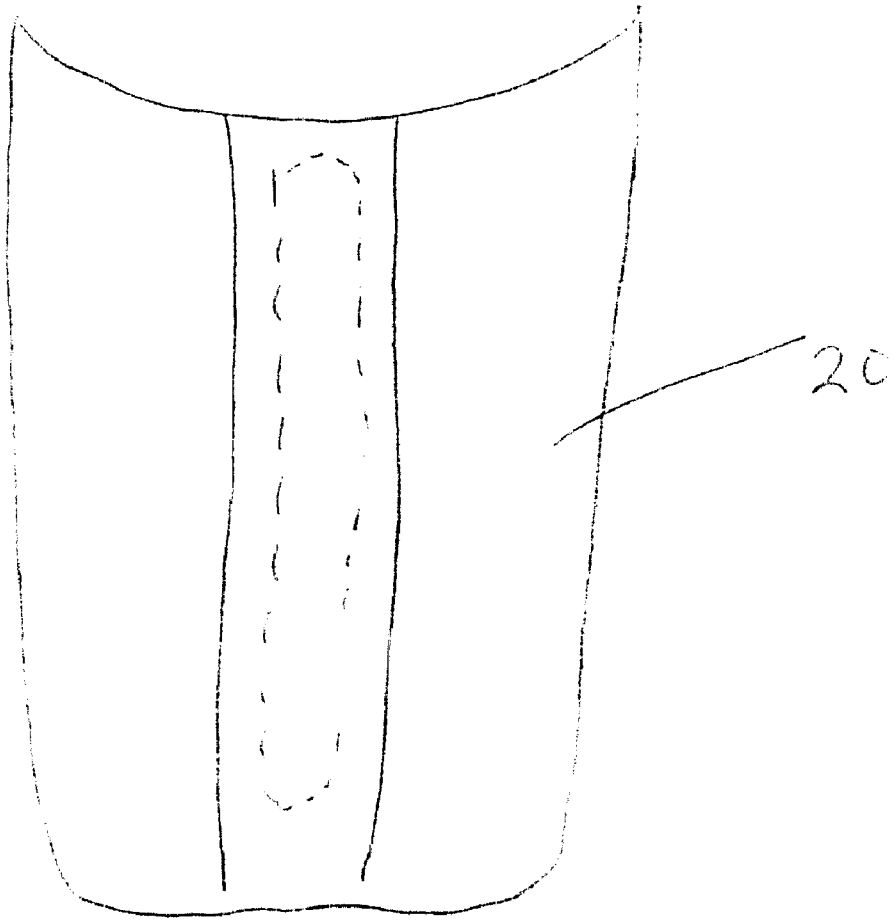
FIG. 5 shows the bottom portion of the internal layer of a shoe of this invention with the remainder of the shoe cut away.

The shoe of this invention also has a tongue 30 which preferably extends to about the same height as layers 10 and 20. Tongue 30 may be comprised of the same or different material as the layer 10 or the layer and is comprised of any material typically used for shoes. Preferably, tongue 30 will be padded, and such padding should preferably not exceed about one-half inch in thickness to avoid unnecessary bulkiness of the shoe. As shown in FIG. 4, on each side of the lower end of tongue 30, near the top of the instep portion 35 of the shoe, is a piece 32 of elastic or similar strong but stretchy material which is connected to the tongue 30 and to the main body 40 of the shoe. Such connection is made in a secure manner, by stitching or other methods known in the art, to attach the tongue 30 to the shoe, while affording some additional flexibility and support for the foot, particularly in the area of the arch and instep.

Figure 2:
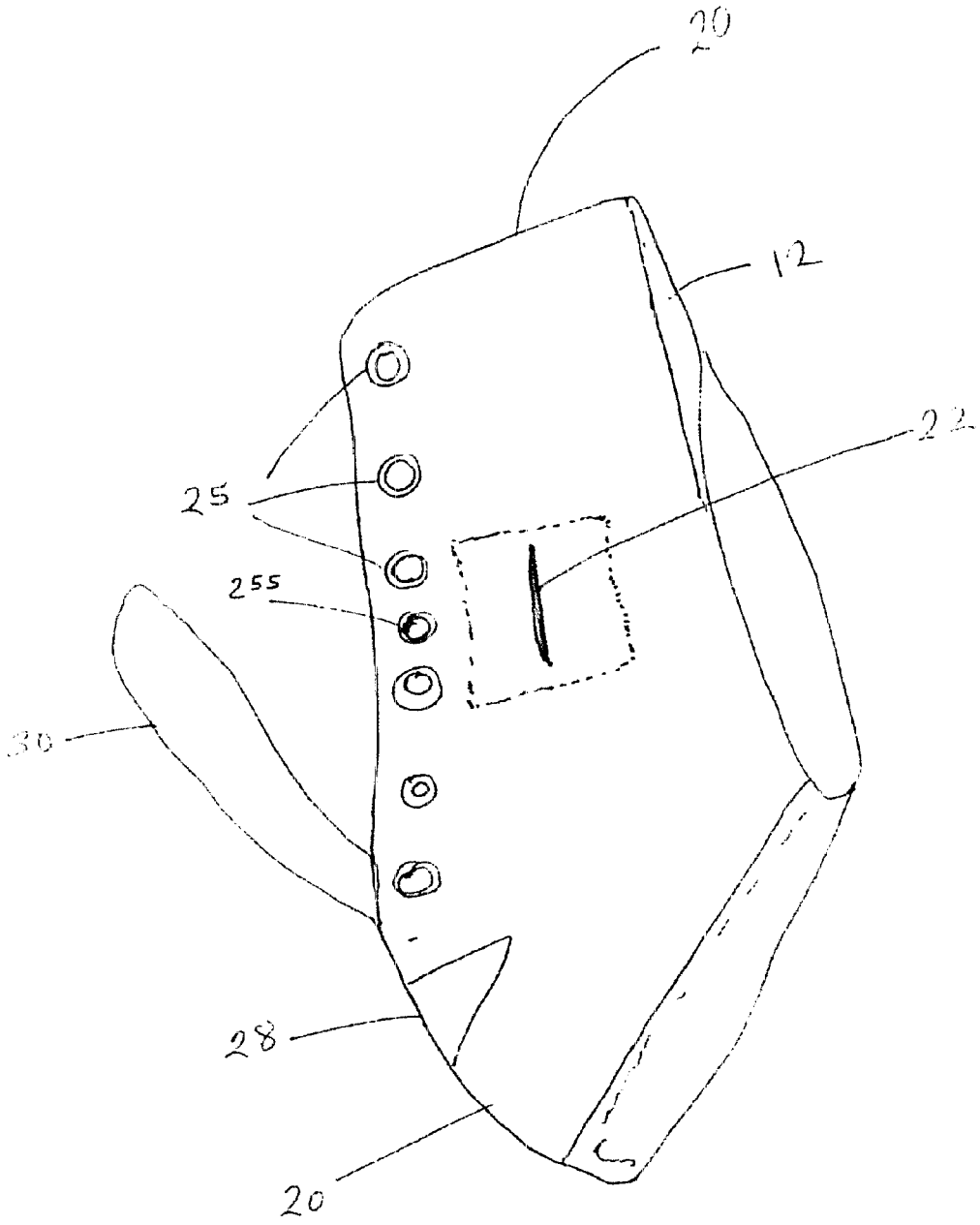
FIG. 2 shows a side and partial bottom view of the internal layer of a shoe of this invention, cut-away from the remainder of the shoe.

About at the position that layers 10 and will fit or lay over the ankle of the wearer when the shoe of this invention is worn, a piece 22 of elastic or similar strong but stretchy material is inserted into the layer 20, as shown in FIGS. 1 and 4. A portion of the layer may be cut out to accommodate the piece 22 or the layer may be slit to allow give. The piece 22 is attached or inserted into the layer in a manner that will secure it, such as by stitching, and is positioned on the part of the layer that will lay next to the ankle. On each side of the layer 20, below the openings 25 at the base of the layer 20, as shown in FIG. 2, is an insert 28 of elastic or similar stretchy but strong material. This insert is positioned near the arch of the foot.

Extending along the interior sides of the layer 10, preferably from just behind openings 15 to the rear portion 12 and preferably the full length of the side of the layer 10 from top to sole 50, is elastic or similar strong but stretchy material. Such elastic is preferably a heavy-duty fabric quality elastic with flexibility and strength. An example is a twill elastic comprised of about 67% polyester and 38% rubber manufactured by the Rhode Island Textile Company in Pautucket, R.I. This elastic is attached to the layer 10, by stitching along the top edge of the layer 10 or by other methods known in the art, like a lining for the layer. A piping 17 as shown in FIGS. 3 and 6 may be stitched or stuck along the top edge of the layer 10 to hide the attachment of the elastic to the layer and to facilitate or help facilitate the attachment.

Figure 3:
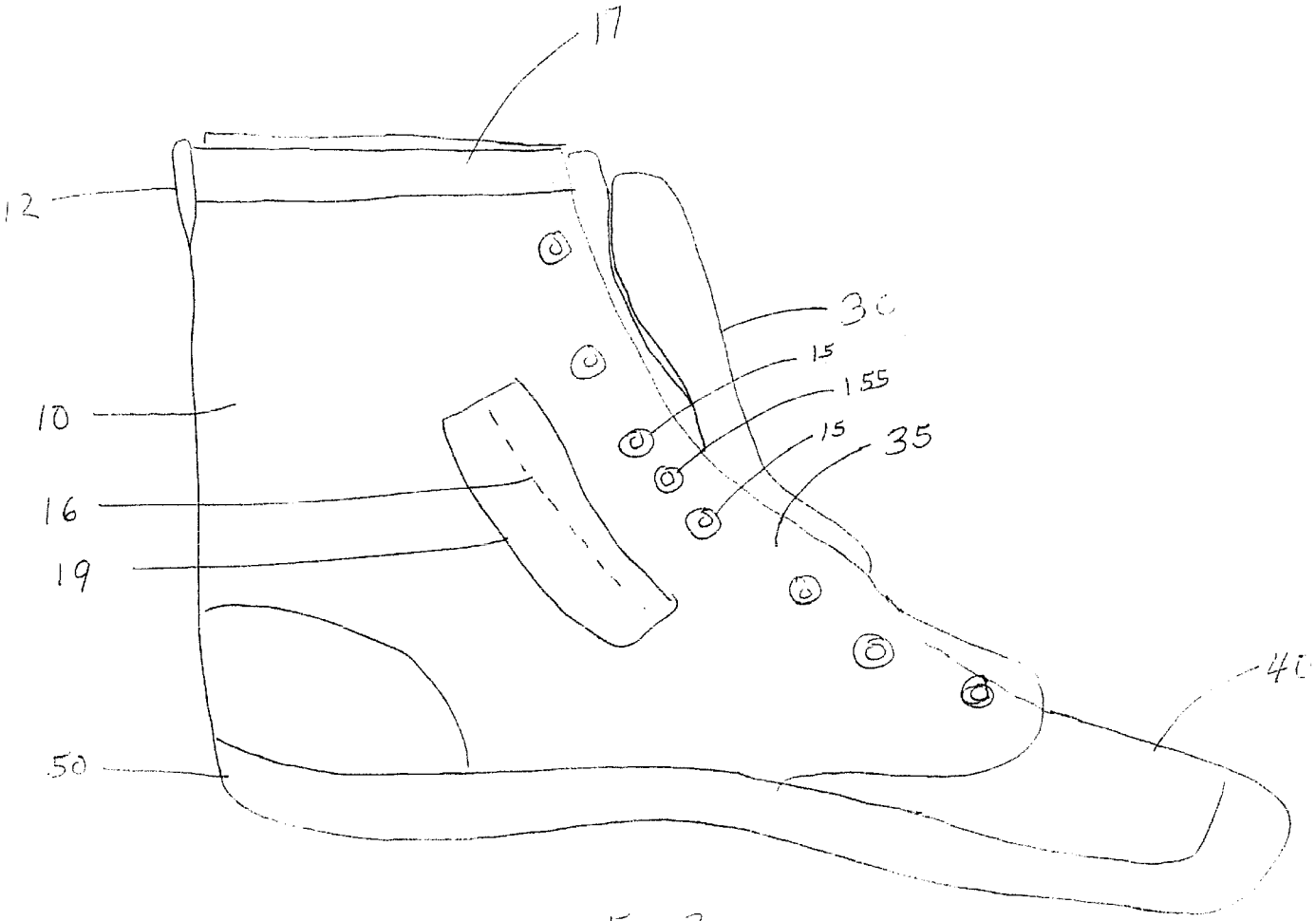
FIG. 3 shows a side view of a shoe of this invention.

Along the exterior sides of the layer 11 preferably in the area that will overlie the ankle, is a slit 16, as shown in FIG. 3. The slit is straight but at an angle roughly parallel to the opening 15 and is about two to three inches in length, depending on the height of the layer 10. The slit may optionally be covered with a decorative piece of material 19 as shown in FIG. 3, without loss of flexibility that the slit allows, provided that the decorative piece is not stitched so as to effectively close the slit.

In an alternative embodiment of this invention, the layer 20, instead of the layer 10, has elastic lining and a slit like 16 described above for the layer 10. The layer 10, instead of elastic lining and a slit 16, has a piece like piece 22 described above for the layer and a cut out to accommodate such piece or a slit to allow give for flexibility. In this embodiment, the layer 20 would not have piece 22. That is, the features of the invention for this alternative embodiment are reversed with respect to the layers 10 and 20.

In either embodiment, the layers 10 and are preferably connected to each other, by stitching or sticking, at least along the bottom or base of the layers where the layers 10 and overlie or touch the inner sole 18 or sole 50. Such connection or attachment should not interfere with the ability of the layers to be laced individually. That is, the layers may be stitched or otherwise connected together, for example, at the base where the layers 10 and fit with or are connected to the main body 40 of the shoe. However, the front part of the layers 10 and near tongue 30 are not connected together so that they may be laced individually. Layer may optionally be removable.

The main body 40 of the shoe may be continuous with the layer 10 or it may be a separate material attached, as for example, by stitching, to the layer 10. If the main body 40 of the shoe is not continuous with the layer 10, the main body 40 of the shoe is comprised of a material that is suitable for and typically used for shoes, and may be comprised of a material the same as or different from the material comprising the layer 10.

The type of the sole 50 of the shoe will depend on preferences of the wearer and the manufacturer and on the use for which the shoe is intended. A flat sole comprised of leather or rubber is preferred for power lifting. A slight heel may be desired for some other sports such as running or basketball. Any sole suitable for shoes may be used with this invention.

Figure 7:
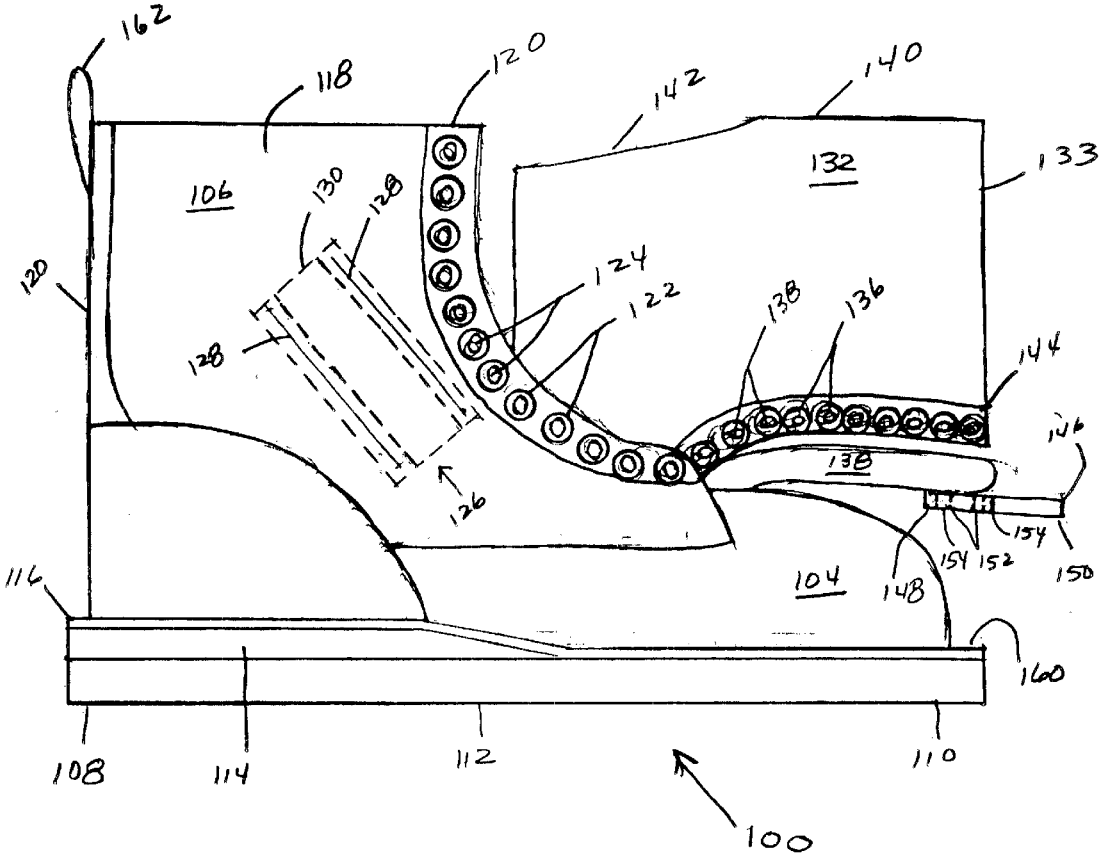
FIG. 7 shows another embodiment of this invention with a dual-slitted area over the ankle area and with a lacing holder.

Another embodiment of the invention is shown in FIG. 7. A shoe 100 has a sole 102 made of a flexible material. A toe section 104 is connected to a toe end 110 of the sole 102 by a method such as stitching. The toe section 104 is somewhat rounded, as opposed to boxed, to allow room for the toes of the wearer (not shown) to naturally expand laterally and forward when the wearer plants a foot (not shown) such as when getting ready to lift weights (not shown). This extended-toe phenomenon provides a larger base surface which provides better support for the foot and helps prevent roll-over of the foot.

An outer shoe 106 is connected to the sole 102 at a heel end 108 and sides 112 of the sole 102. The outer shoe 106 also is attached to the toe section 104 as shown in FIG. 7. The sole 102 can be a flat, single layer of material or it can be a flat, single layer of material with a wedge 114 at the heel end 108 to provide a slightly raised support for the heel. An inner sole 116 can be placed above the sole 102 and the wedge 114. The embodiment shown in FIG. 7 depicts a flat sole 102 but another embodiment would be a slightly curved sole (not shown) that curves slightly upward towards the toe section 104.

The sole 102 shown in FIG. 7 has a lip 160 which is formed by attaching the toe section 104 and the outer shoe 106 to the sole 102, not at the edge of the sole 102, but rather at a selected spacing from the edge of the sole 102. The lip 160 makes the sole 102 wider and thereby provides additional support to lessen the tendency of the foot to roll over when stress is applied to the foot.

The outer shoe 106 has two sides 118 that each have an outer shoe lacing area 120 and which extend up over the ankle area. One preferred embodiment extends the sides 118 to approximately two inches above the ankle area. Each of the sides 118 has at least one slitted area 126 over the ankle area. FIG. 7 shows one such slitted area 126. The slitted area 126 in one embodiment is formed by making two slits 128 in the area of the outer shoe 106 that covers the ankle area. The slits 128 are approximately two and a half inches long and approximately one inch apart. In this embodiment the slits 128 are approximately diagonally placed over the ankle area. The lengths and spacing are meant as examples and other lengths and spacing are within the scope of the invention. An insert 130 of stretchable material is attached to the inner surface of each side 118 of the outer shoe 106 on each side of each slit 128 as shown in FIG. 7. These slits 128 and stretchable material allow the sides 118 of the shoe 100 to expand slightly when the wearer flexes the ankle area while still providing strong support for the ankles.

A multiplicity of eyelets 122 form a series of openings 124 for receiving a lacing (not shown). The outer shoe lacing areas 120 start near the top edges of the sides 118 and extend downwardly over the arch (not shown) towards the toe section 104. One embodiment extends the outer shoe lacing areas to about two inches from the end of the toe section 104 to provide support to the arch as well as the ankle (not shown). The eyelets 122 are large and placed closely together to provide as much support as possible from the lacing. One preferred embodiment uses twelve eyelets 122 in each outer shoe lacing area 120.

An inner shoe 132 is disposed within the outer shoe 106 such that the inner shoe 132 embraces the instep and ankle area of the wearer. The inner shoe 132, in one embodiment, is made of a single piece of material with the center of the material placed under the foot and the ends of the material brought upward to form a top 133 of the inner shoe 106. A portion of the material on one side of the inner shoe 132 is connected, as shown in FIG. 7, to the corresponding portion of the material on the other side of the inner shoe to form a back 140. The inner shoe 132 can be removable or it can be connected to the shoe 100 by attaching it to the outer shoe 106 or attaching it to one end of a tongue 134 as shown in FIG. 7. In one preferred embodiment, the material is cut around the heel area to leave an opening 142 for the heel as shown in FIG. 7.

The inner shoe has a multiplicity of eyelets 136 forming openings 138 in an inner shoe lacing area 144 for receiving the lacing (not shown), similar to the eyelets 122 in the outer shoe 106. When the inner shoe 132 is disposed within the outer shoe 106, the eyelets 122 of the outer shoe are directly above the eyelets 136 of the inner shoe such that the openings 124 and 138 form a channel for double lacing—the lacing is laced through corresponding openings in the inner shoe 132 and the outer shoe 106. The embodiment of the inner shoe 132 in FIG. 7 has ten eyelets with twelve eyelets for the outer shoe 106.

The tongue 138 is attached to the toe section 104 and can be attached to the outer shoe 106 or the inner shoe 132 (as shown in FIG. 7) or both. The tongue 138 is placed against the foot and then the inner shoe lacing areas 144 and the outer shoe lacing areas 120 are positioned over the tongue 138 and the shoe is double laced through the inner shoe openings 138 and the outer shoe openings 124. The tongue 138 extends from the toe section 104 upward. In one preferred embodiment, the tongue 138 extends up to the top most eyelet in the inner shoe lacing area 144.

A lacing holder 146 can be attached near the top of the tongue 138 to help prevent the lacing from coming untied. A bottom portion 148 of the lacing holder 146 is attached to the tongue 138 as shown in FIG. 7. Two eyelets 152 are located in the bottom portion 148 which form openings 154 for receiving the ends of the lacing (not shown). After the shoe 100 is laced, the ends of the lacing are put through the openings 154 in the tongue eyelets 152. The lacing is then tied across the bottom portion 148 of the lacing holder 146. A top portion 150 of the lacing holder 146 is then folded over the lacing and fastened to the bottom portion 148 of the lacing holder 146. The fastening can be done with Velcro-type material placed on the inner surface of the top portion 150 and the bottom portion 148 of the lacing holder 146 or other fastening means known in the art.

A pulling tab 162 can be positioned on the top back portion of the outer shoe 106 as shown in FIG. 7 to assist in pulling the back of the outer shoe 106 into position.

This invention includes a method of supporting the foot for athletic activities. The method is described using the elements depicted in FIG. 7. The method includes the steps of preparing the shoe 100 for wearing by deposing the inner shoe 132 within the outer shoe 106 and moving the tongue 138 out over the toe section 104 of the shoe 100; inserting the toes through the inner shoe 132 into the toe section 104; resting the heel of the foot on the inner sole 116 with the back of the foot against the back of the inner shoe 132; laying the tongue 138 of the shoe 100 against the top of the foot; pulling the inner shoe lacing areas 144 into position over the tongue 138 such that the inner shoe 132 embraces the ankle areas and instep of the foot to provide support to these areas; pulling the outer shoe lacing areas 120 into position over the inner shoe lacing areas 144 such that the outer shoe eyelets 122 are centered over the inner shoe eyelets 136; pulling the tops of the sides 118 of the outer shoe 106 (using the pulling tab 162 if appropriate) into position over and above the ankle such that the slitted areas 126 are positioned over the ankle areas to provide flexibility when the muscles around the ankle area are flexed during athletic activities; dual-lacing the shoe 100 starting with the bottom-most eyelets 122 of the outer shoe, continuing with the corresponding pairs of eyelets in the inner shoe 132 and the outer shoe 106 (second through eleventh in FIG. 7) and finishing with the top-most eyelets 122 of the outer shoe; tightening the lacing so that the inner shoe 132 and the outer shoe 106 provide the desired support for the instep, ankle and muscles in the foot; and knotting the lacing. If the shoe 100 includes a lacing holder 146, the ends of the lacing are fitted through the openings 154 in the eyelets 152 in the bottom section 148 of the lacing holder 146; the lacing is tied across the bottom section 148 and knotted; and the top portion 150 of the lacing holder 146 is folded down over the tied lacing and fastened to the bottom section 148.

The shoe of this invention has been described as an athletic shoe, and the example provided is one particularly suited for athletic activities such as power lifting. However, the shoe of this invention may be easily adapted for use as a therapeutic support shoe or for use in other athletic activities. Those skilled in the art will appreciate that various adaptations and modifications of the above described embodiments can be configured without departing from the spirit and scope of this invention as defined by the following claims.

I claim:

1. A shoe for supporting a foot during athletic activities, said shoe having associated therewith a lacing, an ankle area on each side of said foot, a heel area and an instep area, wherein said shoe comprises:

a sole having toe and heel ends and two sides;

a toe section connected to said toe end of said sole, wherein said connected sole and toe section are capable of receiving said foot;

an outer shoe connected to said toe and heel ends and said two sides of said sole, wherein said outer shoe comprises:

two sides fitting over said ankle areas;

an outer shoe lacing area;

a multiplicity of outer shoe eyelets defining holes capable of receiving said lacing, wherein said outer shoe eyelets are located in said outer shoe lacing area;

at least two slitted-areas on each side of said shoe, each said slitted-area formed by two approximately parallel slits positioned diagonally over the ankle areas; and an insert of stretchable material attached on each side of each slit to an inner surface of said outer shoe covering said slitted areas thereby overlaying said ankle areas;

an inner shoe disposed within said outer shoe, said inner shoe capable of embracing said ankle areas and said instep of said foot, wherein said inner shoe comprises:

an inner shoe lacing area; and a multiplicity of inner shoe eyelets defining holes capable of receiving said lacing, wherein said inner shoe eyelets correspond in positioning in said inner shoe lacing area and in size with said outer shoe eyelets for double lacing; and a tongue attached at a first end to said toe section, said tongue underlying said inner shoe lacing area.

2. The shoe of claim 1, wherein said two approximately parallel slits are approximately two and a half inches in length and approximately one inch apart.

3. The shoe of claim 1, wherein the sole further comprises a lip formed by attaching said toe section and said outer shoe to said sole at a selected indentation distance from an edge of said sole.

* * * * *